US010295939B2

(12) United States Patent
Yoshinaga et al.

(10) Patent No.: US 10,295,939 B2
(45) Date of Patent: May 21, 2019

(54) FIXING DEVICE INCLUDING A PRESSURE ROTATOR AND A THERMAL CONDUCTION AID, AND IMAGE FORMING APPARATUS INCLUDING THE FIXING DEVICE

(71) Applicants: Hiroshi Yoshinaga, Chiba (JP); Kenji Ishii, Kanagawa (JP); Ippei Fujimoto, Kanagawa (JP); Takashi Seto, Kanagawa (JP); Takayuki Seki, Kanagawa (JP); Kazunari Sawada, Shizuoka (JP); Ryohei Matsuda, Kanagawa (JP)

(72) Inventors: Hiroshi Yoshinaga, Chiba (JP); Kenji Ishii, Kanagawa (JP); Ippei Fujimoto, Kanagawa (JP); Takashi Seto, Kanagawa (JP); Takayuki Seki, Kanagawa (JP); Kazunari Sawada, Shizuoka (JP); Ryohei Matsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/627,693

(22) Filed: Jun. 20, 2017

(65) Prior Publication Data

US 2018/0011432 A1 Jan. 11, 2018

(30) Foreign Application Priority Data

Jul. 7, 2016 (JP) ..... 2016-134882

(51) Int. Cl.
*G03G 15/20* (2006.01)

(52) U.S. Cl.
CPC ..... *G03G 15/2032* (2013.01); *G03G 15/2007* (2013.01); *G03G 15/2042* (2013.01);
(Continued)

(58) Field of Classification Search
CPC ..... G03G 15/2007; G03G 15/2017; G03G 15/2032; G03G 15/2042; G03G 15/2053;
(Continued)

(56) References Cited

U.S. PATENT DOCUMENTS 5,499,087 A * 3/1996 Hiraoka ..... G03G 15/2064 219/216
2015/0104227 A1* 4/2015 Shimokawa ..... G03G 15/2053 399/329

(Continued)

FOREIGN PATENT DOCUMENTS

JP 4-044083 2/1992
JP 11-190951 7/1999

(Continued)

OTHER PUBLICATIONS

U.S. Appl. No. 15/440,179, filed Feb. 23, 2017.

(Continued)

*Primary Examiner* — Joseph S Wong
(74) *Attorney, Agent, or Firm* — Oblon, McClelland, Maier & Neustadt, L.L.P.

(57) ABSTRACT

A fixing device includes an endless belt and a pressure rotator disposed opposite an outer circumferential surface of the endless belt. The pressure rotator has a first span in an axial direction of the endless belt. A nip formation pad, which is disposed opposite an inner circumferential surface of the endless belt, forms a fixing nip between the endless belt and the pressure rotator. The nip formation pad includes a belt-side face disposed opposite the endless belt. A radiant heater, which is disposed opposite the inner circumferential surface of the endless belt, heats the endless belt. A thermal conduction aid, which contacts the belt-side face of the nip formation pad, conducts heat in the axial direction of the endless belt. The thermal conduction aid has a second span (Continued)

within which the first span of the pressure rotator is provided at the fixing nip.

16 Claims, 5 Drawing Sheets

(52) U.S. Cl.
CPC ..... *G03G 15/2053* (2013.01); *G03G 15/2017* (2013.01); *G03G 15/2064* (2013.01); *G03G 2215/2003* (2013.01); *G03G 2215/2025* (2013.01); *G03G 2215/2029* (2013.01); *G03G 2215/2035* (2013.01)

(58) Field of Classification Search
CPC ..... G03G 15/2035; G03G 15/2065; G03G 2215/2003; G03G 2215/2025; G03G 2215/2029; G03G 2215/2035
See application file for complete search history.

(56) References Cited

U.S. PATENT DOCUMENTS

| | | | |
|---|---|---|---|
| 2016/0161890 | A1 | 6/2016 | Shoji et al. |
| 2016/0223961 | A1 | 8/2016 | Takagi et al. |
| 2016/0274511 | A1 | 9/2016 | Ogino et al. |
| 2016/0274514 | A1 | 9/2016 | Ishii et al. |
| 2016/0334742 | A1 | 11/2016 | Kobashigawa et al. |
| 2016/0378027 | A1 | 12/2016 | Sawada et al. |

FOREIGN PATENT DOCUMENTS

| | | |
|---|---|---|
| JP | 2004-286922 | 10/2004 |
| JP | 2015-102716 | 6/2015 |

OTHER PUBLICATIONS

U.S. Appl. No. 15/375,757, filed Dec. 12, 2016.
U.S. Appl. No. 15/377,234, filed Dec. 13, 2016.
U.S. Appl. No. 15/447,709, filed Mar. 2, 2017.

* cited by examiner

FIXING DEVICE INCLUDING A PRESSURE ROTATOR AND A THERMAL CONDUCTION AID, AND IMAGE FORMING APPARATUS INCLUDING THE FIXING DEVICE

CROSS-REFERENCE TO RELATED APPLICATION

This patent application is based on and claims priority pursuant to 35 U.S.C. § 119 to Japanese Patent Application No. 2016-134882, filed on Jul. 7, 2016, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, to form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt (e.g., an endless belt), and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes an endless belt and a pressure rotator disposed opposite an outer circumferential surface of the endless belt. The pressure rotator has a first span in an axial direction of the endless belt. A nip formation pad, which is disposed opposite an inner circumferential surface of the endless belt, forms a fixing nip between the endless belt and the pressure rotator. The nip formation pad includes a belt-side face disposed opposite the endless belt. A radiant heater, which is disposed opposite the inner circumferential surface of the endless belt heats the endless belt. A thermal conduction aid, which contacts the belt-side face of the nip formation pad, conducts heat in the axial direction of the endless belt. The thermal conduction aid has a second span within which the first span of the pressure rotator is provided at the fixing nip.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes an endless belt and a pressure rotator disposed opposite an outer circumferential surface of the endless belt. The pressure rotator has a first span in an axial direction of the endless belt. A nip formation pad, which is disposed opposite an inner circumferential surface of the endless belt, forms a fixing nip between the endless belt and the pressure rotator. The nip formation pad includes a belt-side face disposed opposite the endless belt. A radiant heater, which is disposed opposite the inner circumferential surface of the endless belt, heats the endless belt. A thermal conduction aid, which contacts the belt-side face of the nip formation pad, conducts heat in the axial direction of the endless belt. The thermal conduction aid has a second span within which the first span of the pressure rotator is provided at the fixing nip.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
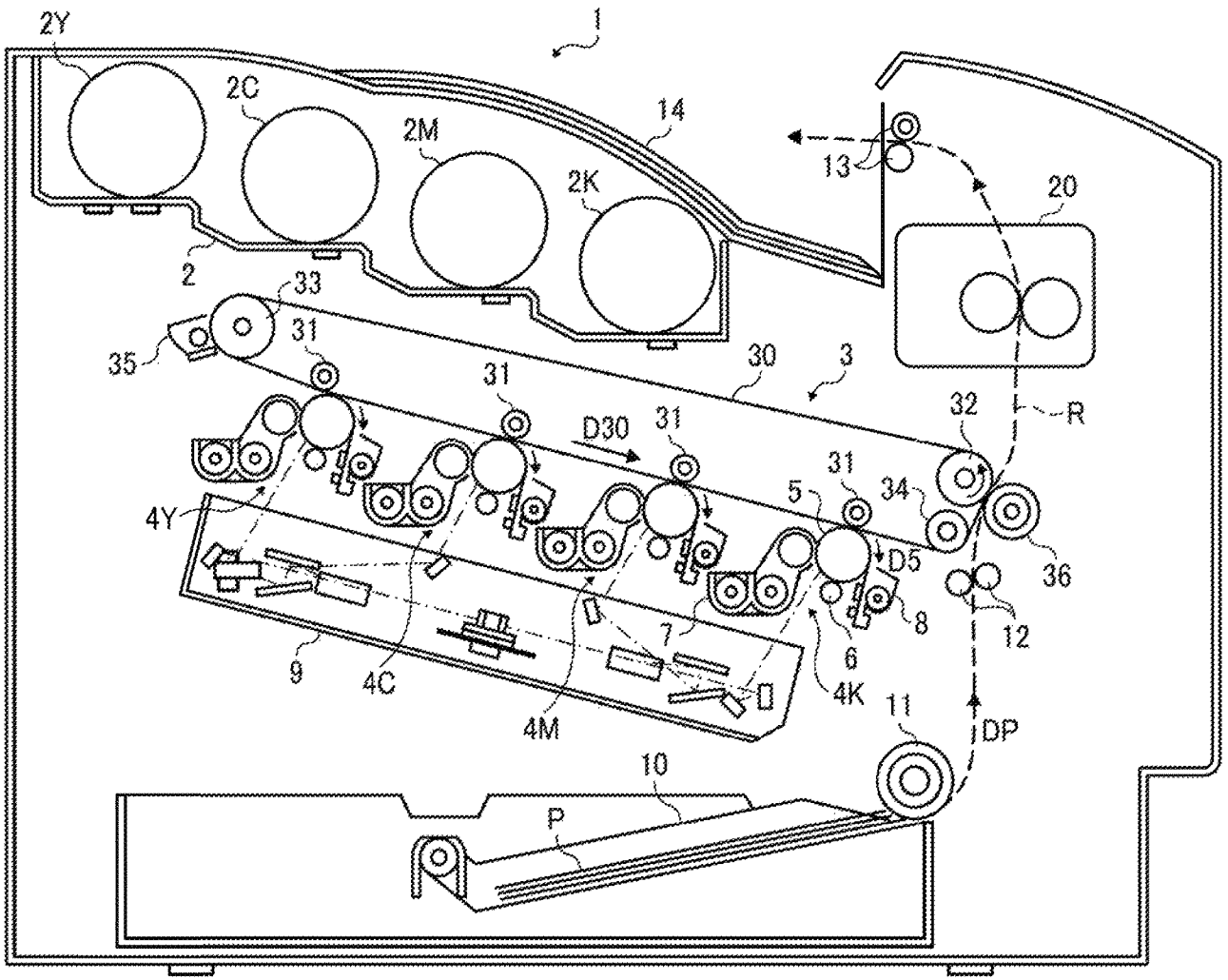
FIG. 1 is a schematic vertical cross-sectional view of an image forming apparatus according to an exemplary embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1 according to an exemplary embodiment is explained.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color printer that forms a color toner image on a recording medium by electrophotography. Alternatively, the image harming apparatus 1 may be a monochrome printer that forms a monochrome toner image on a recording medium.

Referring to FIG. 1, a description is provided of a construction of the image forming apparatus 1.

As illustrated in FIG. 1, the image thrilling apparatus 1 is a color laser printer including four image harming devices 4Y, 4C, 4M, and 4K situated in a center portion of the image forming apparatus 1. The image forming devices 4Y, 4C, 4M and 4K are aligned in a stretch direction in which an intermediate transfer belt 30 is stretched. Although the image forming devices 4Y, 4C, 4M, and 4K contain developers (e.g., yellow, cyan, magenta, and black toners) in different colors, that is, yellow, cyan, magenta, and black corresponding to color separation components of a color image, respectively, the image forming devices 4Y, 4C, 4M, and 4K have an identical structure.

For example, each of the image forming devices 4Y, 4C, 4M, and 4K, serving as an image forming station, includes a photoconductor 5 that is drum-shaped and serves as a latent image bearer or an image bearer that bears an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. FIG. 1 illustrates reference numerals assigned to the photoconductor 5, the charger 6, the developing device 7, and the cleaner 8 of the image forming device 4K that forms a black toner image. However, reference numerals for the image forming devices 4Y, 4C, and 4M that form yellow, cyan, and magenta toner images, respectively, are omitted.

Below the image forming devices 4Y, 4C, 4M, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4C, 4M, and 4K is a transfer device 3. For example, the transfer device 3 includes the intermediate transfer belt 30 serving as a transferor or a transferred image bearer, four primary transfer rollers 31 serving as primary transferors, and a secondary transfer roller 36 serving as a secondary transferors. The transfer device 3 further includes a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction D30 by friction therebetween.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are coupled to a power supply disposed inside the image forming apparatus 1. The power supply applies at least one of a predetermined direct current (DC) voltage and a predetermined alternating current (AC) voltage to each of the primary transfer rollers 31.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is coupled to the power supply disposed inside the image forming apparatus 1. The power supply applies at least one of a predetermined direct current (DC) voltage and a predetermined, alternating current (AC) voltage to the secondary transfer roller 36.

The belt cleaner 35 includes a cleaning brush and a cleaning blade that contact an outer circumferential surface of the intermediate transfer belt 30.

A bottle holder 2 situated in an upper portion of the image forming apparatus 1 accommodates four toner bottles 2Y, 2C, 2M, and 2K detachably attached to the bottle holder 2. The toner bottles 2Y, 2C, 2M, and 2K contain fresh yellow, cyan, magenta, and black totters to be supplied to the developing devices 7 of the image forming devices 4Y, 4C, 4M, and 4K, respectively. For example, the fresh yellow, cyan, magenta, and black totters are supplied from the toner bottles 2Y, 2C, 2M, and 2K to the developing devices 7 through toner supply tubes interposed between the toner bottles 2Y, 2C, 2M, and 2K and the developing devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction DP. The registration roller pair 12 serving as a conveyor conveys the sheet P conveyed from the feed roller 11 toward the secondary transfer nip.

The conveyance path R is further provided with a fixing device 20 located above the secondary transfer nip, that is, downstream from the secondary transfer nip in the sheet conveyance direction DP. The fixing device 20 fixes an unfixed toner image, which is transferred from the intermediate transfer belt 30 onto the sheet P, on the sheet P. The conveyance path R is further provided with the output roller pair 13 located above the fixing device 20, that is, downstream from the fixing device 20 in the sheet conveyance direction DP. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

Referring to FIG. 1, a description is provided of an image forming operation performed by the image forming apparatus 1 having the construction described above to form a full color toner image on a sheet P.

As a print job starts, a driver drives and rotates the photoconductors 5 of the image forming devices 4Y, 4C, 4M, and 4K, respectively, clockwise in FIG. 1 in a rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, cyan, magenta, and black image data constructing color image data sent from the external device, respectively, thus forming electrostatic latent images on the photoconductors 5. The image data used to expose the respective photoconductors 5 is monochrome image data produced by decomposing a desired full color image into yellow, cyan, magenta, and black image data. The developing devices 7 supply yellow, cyan, magenta, and black toners to the electrostatic latent images formed on the photoconductors 5, visualizing the electrostatic latent images as yellow, cyan, magenta, and black toner images, respectively.

Simultaneously, as the print job starts, the secondary transfer backup roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at each of the primary transfer nips formed between the photoconductors 5 and the primary transfer rollers 31, respectively.

When the yellow, cyan, magenta, and black toner images formed on the photoconductors 5 reach the primary transfer nips, respectively, in accordance with rotation of the photoconductors 5, the yellow, cyan, magenta, and black toner images are primarily transferred from the photoconductors 5 onto the intermediate transfer belt 30 by the transfer electric field created at the primary transfer nips such that the yellow, cyan, magenta, and black toner images are superimposed successively on a same position on the intermediate transfer belt 30. Thus, a full color toner image is formed on the outer circumferential surface of the intermediate transfer belt 30. After the primary transfer of the yellow, cyan, magenta, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 through the conveyance path R. The registration roller pair 12 conveys the sheet P sent to the conveyance path R by the feed roller 11 to the secondary transfer nip formed between the secondary transfer roller 36 and the intermediate transfer belt 30 at a proper time. The secondary transfer roller 36 is applied with a transfer voltage having a polarity opposite a polarity of the charged yellow, cyan, magenta, and black toners constructing the full color toner image formed on the intermediate transfer belt 30, thus creating a transfer electric field at the secondary transfer nip.

As the yellow, cyan, magenta, and black toner images constructing the full color toner image on the intermediate transfer belt 30 reach the secondary transfer nip in accordance with rotation of the intermediate transfer belt 30, the transfer electric field created at the secondary transfer nip secondarily transfers the yellow, cyan, magenta, and black toner images from the intermediate transfer belt 30 onto the sheet P collectively. After the secondary transfer of the full color toner image from the intermediate transfer belt 30 onto the sheet P, the belt cleaner 35 removes residual toner fined to be transferred onto the sheet P and therefore remaining on the intermediate transfer belt 30 therefrom. The removed toner is conveyed and collected into a waste toner container situated inside the image forming apparatus 1.

Thereafter, the sheet P bearing the full color toner image is conveyed to the fixing device 20 that fixes the full color toner image on the sheet P. Thereafter, the sheet P bearing the fixed full color toner image is ejected by the output roller pair 13 onto the outside of the image forming apparatus 1, that is, the output tray 14 that stocks the sheet P.

The above describes the image forming operation of the image forming apparatus 1 to form the full color toner image on the sheet P. Alternatively, the image forming apparatus 1 may form a monochrome toner image by, using any one of the four image forming devices 4Y, 4C, 4M, and 4K or may form a bicolor toner image or a tricolor toner image by using two or three of the image forming devices 4Y, 4C, 4M, and 4K.

Figure 2:
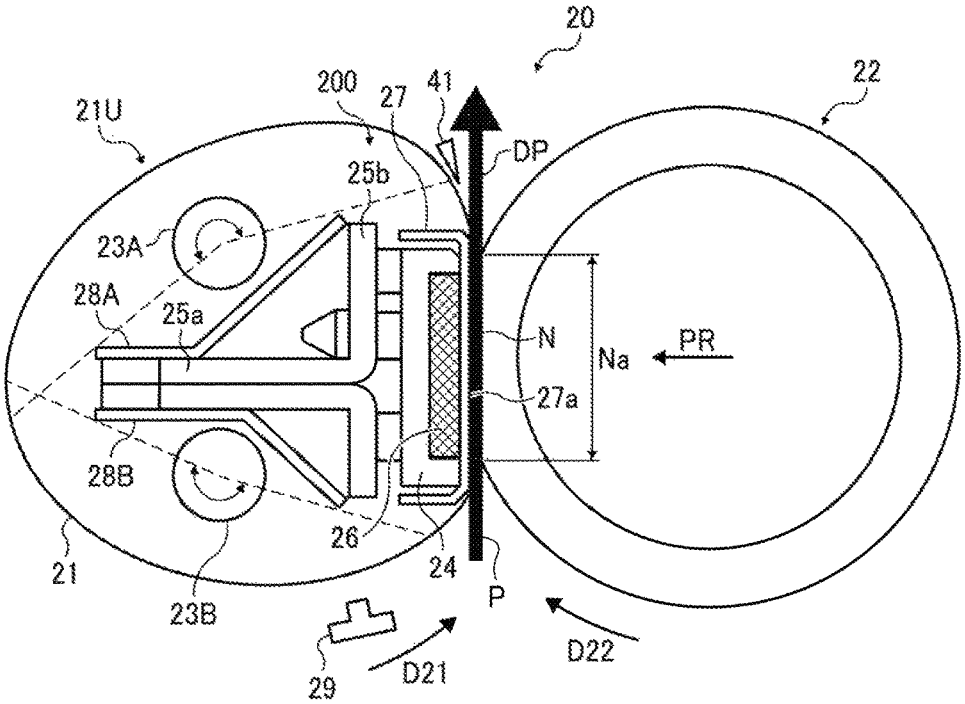
FIG. 2 is a vertical cross sectional view of a fixing device incorporated in the image forming apparatus depicted in FIG. 1.

Referring to FIG. 2, a description is provided of a construction of the fixing device 20 incorporated in the image forming apparatus 1 having the construction described above.

FIG. 2 is a schematic vertical cross-sectional view of the fixing device 20. The fixing device 20 (e.g., a fuser or a fusing unit) includes a fixing belt 21 and a pressure roller 22. The fixing belt 21, serving as a fixing rotator or a fixing member, is an endless belt that is thin, flexible, tubular, and rotatable in a rotation direction D21. The pressure roller 22, serving as a pressure rotator or a pressure member, contacts an outer circumferential surface of the fixing bell 21. The pressure roller 22 is rotatable in a rotation direction D22. Inside a loop formed by the fixing belt 21 is a plurality of heaters or a plurality of fixing heaters, that is, a halogen heater 23A serving as a first radiant heater and a halogen heater 23B serving as a second radiant heater, that heats the fixing belt 21 with radiant heat. Each of the halogen heaters 23A and 23B is a radiant heater serving as a main heater or a fixing heater.

Inside the loop formed by the fixing belt 21 area nip formation pad 24, a stay 25, lateral end heaters 26, a thermal conduction aid 27, and reflectors 28A and 28B. The components disposed inside the loop formed by the fixing belt 21, that is, the halogen heaters 23A and 23B, the nip formation pad 24, the stay 25, the lateral end heaters 26, the thermal conduction aid 27, and the reflectors 28A and 28B, may construct a belt unit 21U separably coupled with the pressure roller 22.

The nip formation pad 24 presses against the pressure roller 22 via the fixing belt 21 to form a fixing nip N between the fixing belt 21 and the pressure roller 22. The stay 25, serving as a support, supports the nip formation pad 24.

A detailed description is now given of a configuration of the nip formation pad 24.

The nip formation pad 24 extending in a longitudinal direction thereof parallel to an axial direction of the fixing belt 21 is secured to and supported by the stay 25. Accordingly, even if the nip formation pad 24 receives pressure from the pressure roller 22, the stay 25 presents the nip formation pad 24 from being bent by the pressure and therefore allows the nip formation pad 24 to produce a uniform nip length throughout the entire width of the pressure roller 22 in an axial direction or a longitudinal direction thereof. The nip formation pad 24 is made of a heat resistant material being resistant against temperatures up to 200 degrees centigrade and having an enhanced mechanical strength. For example, the nip formation pad 24 is made of heat resistant resin such as polyimide (PT), polyether ether ketone (PEEK), and PI or PEEK reinforced with glass fiber. Thus, the nip formation pad 24 is immune from thermal deformation at temperatures in a fixing temperature range desirable to fix a toner image on a sheet P, retaining the shape of the fixing nip N and quality of the toner image formed on the sheet P.

Both lateral ends of the stay 25 and the halogen heaters 23A and 23B in a longitudinal direction thereof are secured to and supported by a pair of side plates of the fixing device 20 or a pair of holders, provided separately from the pair of side plates, respectively.

A detailed description is now given of a configuration of the lateral end heaters 26.

The lateral end heaters 26 are mounted on or coupled with both lateral ends of the nip formation pad 24 in the longitudinal direction thereof, respectively. The lateral end heaters 26 serve as a sub heater provided separately from the main heater or the fixing heater (e.g., the halogen heaters 23A and 23B). The lateral end heaters 26 heat both lateral ends of the fixing belt 21 in the axial direction thereof, respectively. For example, the lateral end heaters 26 heat both lateral ends of the fixing belt 21 contacted by both lateral ends of an extra-large sheet P, such as an A3 extension size sheet, while the extra-large sheet P is conveyed over the fixing belt 21. A width of the extra-large sheet P is greater than a width of an A3 size sheet in portrait orientation. The lateral end heater 26 is a contact beater that contacts the fixing belt 21 to conduct heat to the fixing belt 21, for example, a resistive heat generator such as a ceramic heater.

A detailed description is now given of a configuration of the thermal conduction aid 27.

The thermal conduction aid 27 also serves as a thermal equalizer that facilitates conduction of heat in the axial direction of the fixing belt 21. The thermal conduction aid 27 covers a belt-side face of each of the nip formation pad 24 and the lateral end heaters 26, which is disposed opposite an inner circumferential surface of the fixing belt 21. The thermal conduction aid 27 conducts and equalizes heat in a longitudinal direction of the thermal conduction aid 27 that is parallel to the axial direction of the fixing belt 21, preventing heat from being stored at both lateral ends of the fixing belt 21 in the axial direction thereof while a plurality of small sheets P is conveyed over the fixing belt 21 or while the lateral end heaters 26 are turned on. Thus, the thermal conduction aid 27 eliminates uneven temperature of the fixing belt 21 in the axial direction thereof. Hence, the thermal conduction aid 27 is made of a material that conducts heat quickly, for example, a material having an enhanced thermal conductivity such as copper having a thermal conductivity of 398 W/mk and aluminum having a thermal conductivity of 236 W/mk. The thermal conduction aid 27 includes a belt-side face 27*a* being disposed opposite and in direct contact with the inner circumferential surface of the fixing belt 21, thus serving as a nip formation face that forms the fixing nip N.

As illustrated in FIG. 2, the belt-side liter 27*a* is planar. Alternatively, the belt-side face 27*a* may be curved or recessed or may have other shapes. If the belt-side face 27*a* is recessed with respect to the pressure roller 22, the belt-side face 27*a* directs a leading edge of the sheet P toward the pressure roller 22 as the sheet P is ejected front the fixing nip N, facilitating separation of the sheet P from the fixing belt 21 and suppressing jamming of the sheet P between the fixing belt 21 and the pressure roller 22.

A temperature sensor 29 is disposed opposite the outer circumferential surface of the fixing belt 21 at a proper position thereon, for example, a position upstream from the fixing nip N in the rotation direction D21 of the fixing belt 21. The temperature sensor 29 detects a temperature of the fixing belt 21. A separator 41 is disposed downstream from the fixing nip N in the sheet conveyance direction DP to separate the sheet P from the fixing belt 21. A pressurization assembly presses the pressure roller 22 against the nip formation pad 24 via the fixing belt 21 and releases pressure exerted by the pressure roller 22 to the fixing belt 21.

A detailed description is now given of a construction of the fixing belt 21.

In order to decrease a thermal capacity of the fixing belt 21, the fixing belt 21, that is, an endless belt being thin like film and having a downsized loop diameter, is constructed of a base layer serving as the inner circumferential surface of the fixing belt 21 and a release layer serving as the outer circumferential surface of the fixing belt 21. The base layer is made of metal such as nickel and SUS stainless steel or resin such as PI. The release layer is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluoro rubber may be interposed between the base layer and the release layer.

While the fixing belt 21 and the pressure roller 22 pressingly sandwich the unfixed toner image on the sheet P to fix the toner image on the sheet P, the elastic layer having a thickness of about 100 micrometers elastically deforms to absorb slight surface asperities of the fixing belt 21, preventing variation in gloss of the toner image on the sheet P. In order to decrease the thermal capacity of the fixing belt 21, the fixing belt 21 has a total thickness not greater than 1 mm and a loop diameter in a range of from 20 mm to 40 mm. For example, the fixing belt 21 is constructed of the base layer having a thickness in a range of from 20 micrometers to 50 micrometers; the elastic layer having a thickness in a range of from 100 micrometers to 300 micrometers; and the release layer having a thickness in a range of from 10 micrometers to 50 micrometers, in order to decrease the thermal capacity of the fixing belt 21 further, the fixing belt 21 may have a total thickness not greater than 0.20 mm and preferably not greater than 0.16 mm. The loop diameter of the fixing belt 21 is not greater than 30 mm.

A detailed description is now given of a construction of the stay 25.

The stay 25, having a T-shape in cross-section, includes a base 25*b* disposed opposite the fixing nip N and an arm 25*a* projecting from the base 25*b* and being disposed opposite the nip formation pad 24 via the base 25*b*. In other words, the arm 25*a* of the stay 25 projects from the nip formation pad 24 in a pressurization direction PR in which the pressure roller 22 presses against the nip formation pad 24 via the fixing belt 21. The arm 25*a* is interposed between the halogen heaters 23A and 23B serving as the main heater to screen the halogen heater 23A from the halogen heater 23B.

A detailed description is now given of a construction of the halogen heaters 23A and 23B.

The halogen heater 23A includes a center heat generator disposed in a center span of the halogen heater 23A in the longitudinal direction thereof. A small sheet P is disposed opposite the center heat generator of the halogen heater 23A. The halogen heater 23B includes a lateral end heat generator disposed in each lateral end span of the halogen heater 23B in the longitudinal direction thereof. A large sheet P disposed opposite the lateral end heat generator of, the halogen heater 23B. The power supply situated inside the image forming apparatus 1 supplies power to the halogen heaters 23A and 23B so that the halogen heaters 23A and 23B generate heat. A controller operatively connected to the halogen heaters 23A and 23B and the temperature sensor 29 controls the halogen heaters 23A and 23B based on the temperature of the outer circumferential surface of the fixing belt 21, which is detected by the temperature sensor 29 disposed opposite the outer circumferential surface of the fixing belt 21. Thus, the temperature of the fixing belt 21 is adjusted to a desired fixing temperature.

A detailed description is now given of a configuration of the reflectors 28A and 28B.

The reflector 28A is interposed between the halogen heater 23A and the stay 25. The reflector 28B is interposed between the halogen heater 23B and the stay 25. The reflectors 28A and 28B reflect light, and heat radiated from the halogen heaters 23A and 23B to the reflectors 28A and 28B, respectively, toward the fixing belt 21, thus enhancing heating efficiency of the halogen heaters 23A and 23B to heat the fixing belt 21. Additionally, the reflectors 28A and 28B prevent light and heat radiated front the halogen heaters 23A and 23B from heating the stay 25 with radiant heat, suppressing waste of energy. Alternatively, instead of the reflectors 28A and 28B, an opposed face of the stay 25 disposed opposite the halogen heaters 23A and 23B may be treated with insulation or mirror finish to reflect light and heat radiated from the halogen beaters 23A and 23B to the stay 25 toward the fixing belt 21.

A detailed description is now given of a construction of the pressure roller 22.

The pressure roller 22 is constructed of a core bar; an elastic layer coating the core bar and being made of silicone rubber foam, fluoro rubber, or the like; and a release layer coating the elastic layer and being made of PFA, PTFE, or the like. The pressurization assembly such as a spring presses the pressure roller 22 against the fixing belt 21 to form the fixing nip N. The pressure roller 22 pressingly contacting the fixing belt 21 deforms the elastic layer of the pressure roller 22 at the fixing nip N formed between the pressure roller 22 and the fixing belt 21, thus defining the fixing nip N having a predetermined length in the sheet conveyance direction DP.

A driver (e.g., a motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 in accordance with rotation of the pressure roller 22 by friction between the pressure roller 22 and the fixing belt 21. Alternatively, the driver may also be connected to the fixing belt 21 to drive and rotate the fixing belt 21.

In a nip span Na of the fixing nip N, the fixing belt 21 rotates as the fixing belt 21 is sandwiched between the pressure roller 22 and the nip formation pad 24; in a circumferential span of the fixing belt 21 other than the nip span Na, the fixing belt 21 rotates while the fixing belt 21 is guided by flanges secured to the pair of side plates at both lateral ends of the fixing belt 21 in the axial direction thereof, respectively.

According to this exemplary embodiment, the pressure roller 22 is a solid roller. Alternatively, the pressure roller 22 may be a hollow roller. In this case, a heater such as a halogen heater may be disposed inside the hollow roller. The elastic layer of the pressure roller 22 may be made of solid rubber. Alternatively, if no heater is situated inside the pressure roller 22, the elastic layer of the pressure roller 22 may be made of sponge rubber. The sponge rubber is more preferable than the solid rubber because the sponge rubber has an increased insulation that draws less heat from the fixing belt 21.

Figure 3:
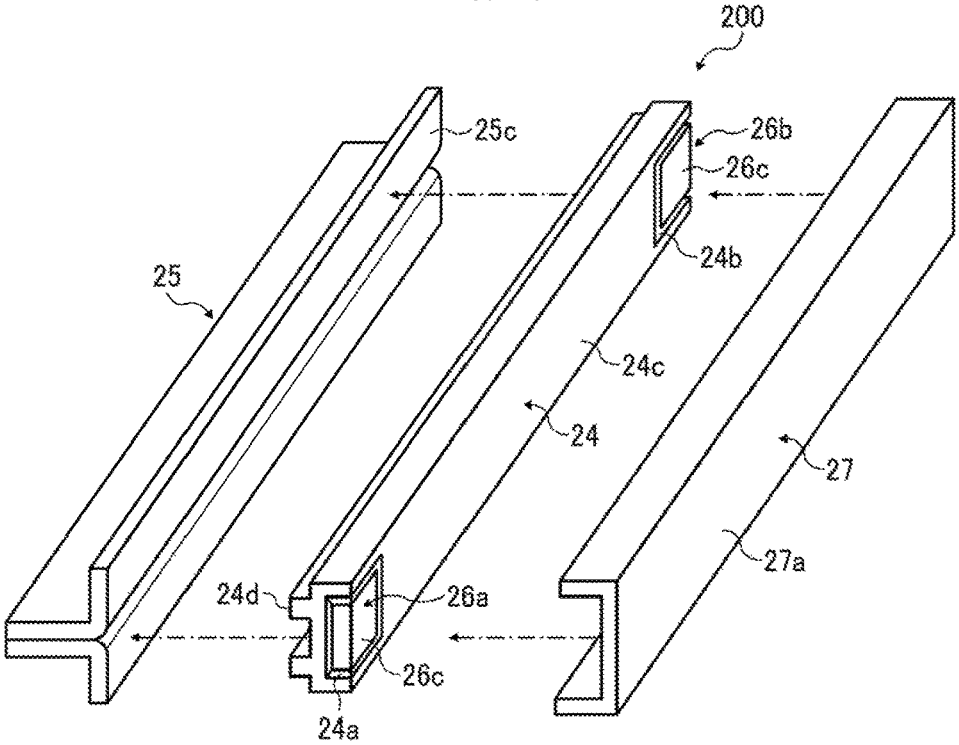
FIG. 3 is an exploded perspective view of a nip formation unit incorporated in the fixing device depicted in FIG. 2.

Referring to FIG. 3, a description is provided of a construction of a nip formation unit 200 incorporated in the fixing device 20 depicted in FIG. 2.

FIG. 3 is an exploded perspective view of the nip formation unit 200, illustrating a basic structure of the nip formation unit 200. As illustrated in FIG. 3, the nip formation unit 200 includes the nip formation pad 24, the stay 25, the thermal conduction aid 27, and lateral end heaters 26*a* and 26*b* illustrated as the lateral end heaters 26 in FIG. 2. The nip formation pad 24 includes a belt-side face 24*c* disposed opposite the fixing nip N and the inner circumferential surface of the fixing belt 21 and a stay-side face 24*d* being opposite the belt-side face 24*e* and disposed opposite the stay 25. The stay 25 includes a belt-side face 25*c* being planar and disposed opposite the fixing nip N and the inner circumferential surface of the fixing belt 21.

The stay-side face 24*d* of the nip formation pad 24 contacts the belt-side face 25*c* of the stay 25. For example, the stay-side face 24*d* of the nip formation pad 24 and the belt-side face 25*c* of the stay 25 mount a recess and a projection (e.g., a boss and a pin), respectively, so that the stay-side face 24*d* engages the belt side face 25*e* to restrict each other with the shape of the stay-side face 24*d* and the belt-side face 25*c*. The thermal conduction aid 27 engages the nip formation pad 24 that is substantially rectangular such that the thermal conduction aid 27 covers the belt-side face 24*c* of the nip formation pad 24 that is disposed opposite the inner circumferential surface of the fixing belt 21. Thus, the thermal conduction aid 27 is coupled with the nip formation pad 24. For example, the thermal conduction aid 27 is coupled with the nip formation pad 24 with a claw, an adhesive, or the like.

Two recesses 24*a* and 24*b*, each of which defines a step or a difference in thickness of the nip formation pad 24, are disposed at both lateral ends of the nip formation pad 24 in the longitudinal direction thereof, respectively. The lateral end heaters 26*a* and 26*b* are secured to the recesses 24*a* and 24*b*, thus being accommodated by the recesses 24*a* and 24*b*, respectively.

The thermal conduction aid 27 includes the belt-side face 27*a* that is disposed opposite the inner circumferential surface of the fixing belt 21. The belt-side face 27*a* serves as a slide face over which the fixing belt 21 slides. However, since a mechanical strength of the belt-side face 24*c* of the nip formation pad 24 is greater than a mechanical strength of the belt-side face 27*a* of the thermal conduction aid 27, the belt-side face 24*c* of the nip formation pad 24 serves as a nip formation face that is disposed opposite the pressure roller 22 and forms the fixing nip N practically.

According to this exemplary embodiment, the lateral end heaters 26*a* and 26*b* are coupled with the nip formation pad 24 to form the fixing nip N. Hence, the lateral end heaters 26*a* and 26*b* are situated inside a limited space inside the loop formed by the fixing belt 21, saving space.

Each of the lateral end heaters 26*a* and 26*b* includes a belt-side face 26*c* disposed opposite the inner circumferential surface of the fixing belt 21. The belt-side face 26*c* of each of the lateral end heaters 26*a* and 26*b* is leveled with the belt-side face 24*c* of the nip formation pad 24 that is disposed opposite the inner circumferential surface of the fixing belt 21 in the pressurization direction PR depicted in FIG. 2 in which the pressure roller 22 presses against the nip formation pad 24 so that the belt-side faces 26*c* and the belt-side face 24*c* define an identical plane. Accordingly, the pressure roller 22 is pressed against the lateral end heaters 26*a* and 26*b* via the fixing belt 21 and the thermal conduction aid 27 sufficiently.

Consequently, the fixing belt 21 rotates stably in a state in which the fixing belt 21 is pressed against the lateral end heaters 26*a* and 26*b* or adhered to the lateral end heaters 26*a* and 26*b* indirectly via the thermal conduction aid 27. The fixing bolt 21 is pressed against the lateral end heaters 25*a* and 26*b* with sufficient pressure, retaining improved beating efficiency of the lateral end heaters 26*a* and 26*b*. Hence, the fixing device 20 enhances reliability.

As described above, the lateral end heaters 26*a* and 26*b* heat both lateral ends of the fixing belt 21 in the axial direction, respectively. Hence, the fixing belt 21 heats both lateral ends of the extra-large sheet P, such as the A3 extension size sheet, while the extra-large sheet P is conveyed over the fixing belt 21, thus fixing the toner image on the extra-large sheet P. The width of the extra-large sheet P is greater than the width of the A3 size sheet in portrait orientation. The thermal conduction aid 27 conducts and equalizes heat in the axial direction of the fixing belt 21 and thereby eliminates uneven temperature of the fixing belt 21 in the axial direction thereof.

A description is provided of a construction of a comparative fixing device.

An image forming apparatus incorporating the comparative fixing device may form a toner image on sheets of various sizes. The image forming apparatus may form the toner image on an A3 extension size sheet having a width greater than the width of 297 mm of the A3 size sheet in portrait orientation. The comparative fixing device may include a heater for heating a fixing belt, which has a radiation span, in which the heater radiates heat, which is equivalent to the width of the A3 extension size sheet. In this case, after a plurality of sheets, each of which has a width not greater than the width of the A3 size sheet in portrait orientation, is conveyed over the fixing belt continuously, a non-conveyance span of the fixing belt where the sheets have not been conveyed may overheat, resulting in adjustment of productivity of the comparative fixing device.

To address this circumstance, the fixing device 20 depicted in FIGS. 2 and 3 includes the fixing belt 21 serving as an endless belt, the pressure roller 22 serving as a pressure rotator, the halogen heaters 23A and 23B serving as a radiant heater, the nip formation pad 24, and the thermal conduction aid 27. The pressure roller 22 is disposed opposite the fixing belt 21. The halogen heaters 23A and 23B heat the fixing belt 21. The nip formation pad 24 presses against the pressure roller 22 via the fixing belt 21 to form the fixing nip N between the fixing belt 21 and the pressure roller 22. The thermal conduction aid 27 covers the belt-side face 24*c* of the nip formation pad 24, which is disposed opposite the fixing belt 21. The thermal conduction aid 27 conducts heat in the axial direction of the fixing belt 21.

The thermal conduction aid 27 also serving as a thermal equalizer conducts heat in the axial direction of the fixing belt 21. The thermal conduction aid 27 prevents heat from being stored at both lateral ends of the fixing belt 21 in the axial direction thereof when a plurality of small sheets P is conveyed over the fixing belt 21 while the halogen heaters 23A and 23B are turned on. Thus, the thermal conduction aid 27 eliminates uneven temperature of the fixing belt 21 in the axial direction thereof.

However, the belt-side face 27*a* of the thermal conduction aid 27, that is disposed opposite the inner circumferential surface of the fixing belt 21, contacts the fixing belt 21 directly. While the fixing belt 21 rotates, the fixing belt 21 slides over the thermal conduction aid 27. The thermal conduction aid 27 is made of a material having an enhanced thermal conductivity that enables heat conduction within a shortened time period, for example, metal such as copper and aluminum. Accordingly, a lateral edge of the thermal conduction aid 27 in the longitudinal direction thereof may damage or scratch the inner circumferential surface of the fixing belt 21, resulting in breakage or fracture of the fixing belt 21.

Figure 4:
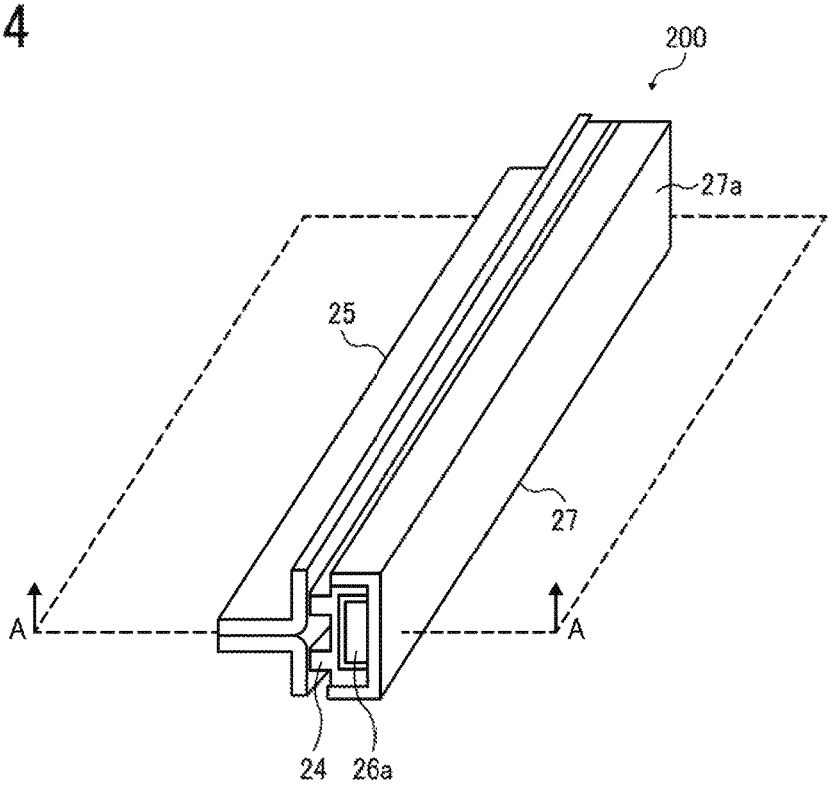
FIG. 4 is a perspective view of the nip formation unit depicted in FIG. 3 that is assembled.
Figure 5A:
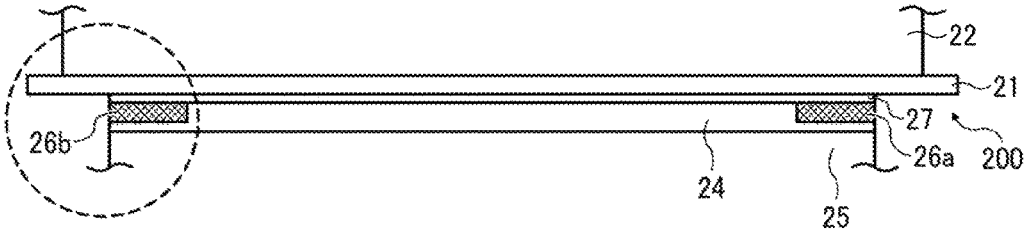
FIG. 5A is a cross-sectional view of a pressure roller, a fixing belt, and the nip formation unit taken on a cross-section A in FIG. 4 as a disadvantageous configuration.
Figure 5B:
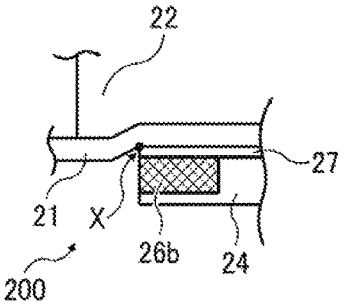
FIG. 5B is an enlarged view of a part of the pressure roller, the fixing belt, and the nip formation unit, which is indicated by a dotted circle in FIG. 5A.

FIG. 4 is a perspective view of the nip formation unit 200 that is as FIG. 5A is a cross-sectional view of the pressure roller 22, the fixing belt 21, and the nip formation unit 200 taken on a cross-section A-A in FIG. 4. FIG. 5B is an enlarged view of a part of the pressure roller 22, the fixing belt 21, and the nip formation unit 200, which is indicated by a dotted circle in FIG. 5A.

Referring to FIGS. 5A and 5B, a description is provided of disadvantages of a configuration illustrated in FIGS. 5A and 5B.

As illustrated in FIG. 5A, at the fixing nip N, a width of the pressure roller 22 in the axial direction thereof is greater than a width of the thermal conduction aid 27 in the longitudinal direction thereof. While the pressure roller 22 and, the fixing belt 21 fix the toner image on the sheet P, the pressure roller 22 rotates while the pressure roller 22 presses the fixing belt 21 against the thermal conduction aid 27 with substantial pressure. Accordingly, the surface elastic layer of the pressure roller 22 deforms and the fixing belt 21 slides over the thermal conduction aid 27.

As illustrated in FIG. 5B, as the elastic layer of the pressure roller 22 deforms, the fixing belt 21 is bent by a lateral end, specifically, the lateral edge, of the thermal conduction aid 27 in the longitudinal direction thereof. Thus, the fixing belt 21 is subject to locally increased stress. Simultaneously, the lateral edge of the thermal conduction aid 27 in the longitudinal direction thereof is pressed against the inner circumferential surface of the fixing belt 21 at a point X or a vicinity of the point X with substantial pressure. While the fixing belt 21 rotates, the fixing belt 21 continues sliding over the lateral edge of the thermal conduction aid 27. Accordingly, the fixing belt 21 may suffer from breakage or fracture originating front the point X or the vicinity of the point X on the inner circumferential surface of the fixing belt 21.

To address this circumstance, the fixing device 20 has a configuration described below to prevent breakage and fracture of the fixing belt 21 caused by sliding of the inner circumferential surface of the fixing belt 21 over the lateral edge of the thermal conduction aid 27 in the longitudinal direction thereof and thereby improve durability of the fixing device 20.

A description is provided of a configuration of the fixing device 20 according to a first exemplary embodiment.

Figure 6A:
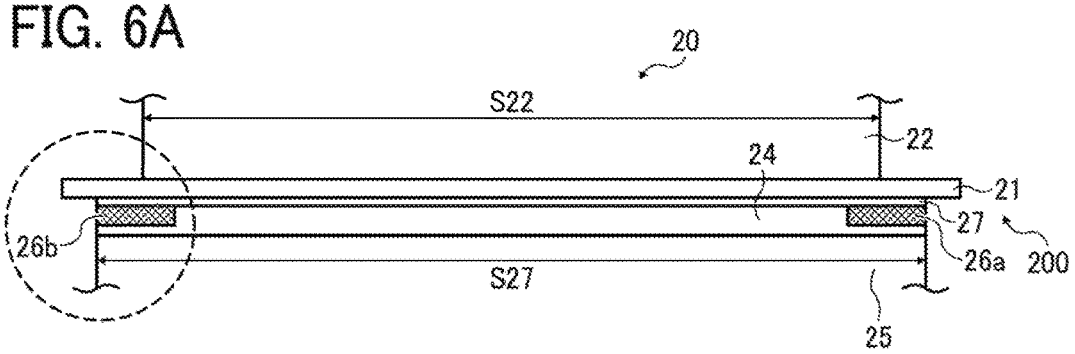
FIG. 6A is a cross-sectional view of the pressure roller, the fixing belt, and the nip formation unit incorporated in the fixing device depicted in FIG. 2 according to a first exemplary embodiment.
Figure 6B:
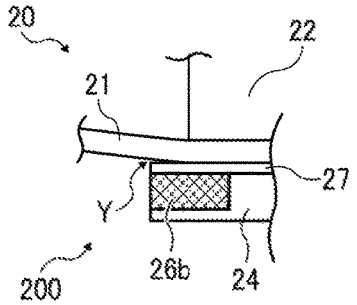
FIG. 6B is art enlarged view of a part of the pressure roller, the fixing belt, and the nip formation unit, which is indicated by a dotted circle in FIG. 6A.

FIG. 6A is a cross-sectional view of the pressure roller 22, the fixing belt 21, and the nip formation unit 200. FIG. 6B is an enlarged view of a part of the pressure roller 22, the fixing belt 21, and the nip formation unit 200, which is indicated by a dotted circle in FIG. 6A. Identical reference numerals are assigned to components illustrated in FIGS. 6A and 6B that are identical to the components illustrated in FIGS. 5A and 5B and description of the identical components is omitted.

As illustrated in FIG. 6A, at the fixing nip N, a span S22 of the pressure roller 22 in the axial direction thereof is within a span S27 of the thermal conduction aid 27 in the longitudinal direction thereof. As illustrated in FIG. 6B, since the elastic layer of the pressure roller 22 is not pressed against the lateral end of the fixing belt 21 in the axial direction thereof, the lateral end of the fixing belt 21 in the axial direction thereof does not bend toward the thermal conduction aid 27. Since the inner circumferential surface of the fixing belt 21 does not contact or does lightly touch the lateral edge of the thermal conduction aid 27 at a position Y and a vicinity of the position Y, the inner circumferential surface of the fixing belt 21 does not continue sliding over the lateral edge of the thermal conduction aid 27 even while the fixing belt 21 rotates in the rotation direction D21 to fix the toner image on the sheet P. Accordingly, the fixing device 30 prevents breakage and fracture of the fixing belt 21, which originates from the inner circumferential surface of the fixing belt 21, thus improving durability of the fixing device 20.

A description is provided of a configuration of a fixing device 20S incorporating a nip formation unit 200S according to a second exemplary embodiment.

Figure 7:
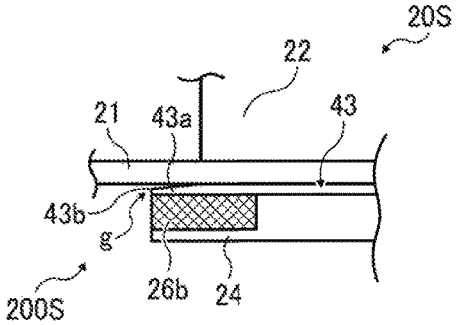
FIG. 7 is a cross-sectional view of the pressure roller, the fixing belt, and the nip formation unit incorporated in the fixing device depicted in FIG. 2 according to a second exemplary embodiment.

FIG. 7 is a cross-sectional view of the pressure roller 22, the fixing belt 21, and the nip formation unit 200S. Identical reference numerals are assigned to components illustrated in FIG. 7 that are identical to the components illustrated in FIGS. 5A and 5B and description of the identical components is omitted.

As illustrated in FIG. 7, the nip formation unit 200S includes a thermal conduction aid 43 that includes a slope g disposed at a lateral end 43*a* of the thermal conduction aid 43 in a longitudinal direction thereof. The slope g tapers off a lateral edge 43*b* of the thermal conduction aid 43 in the longitudinal direction thereof. The thickness of the lateral end 43*a* of the thermal conduction aid 43 in a direction perpendicular to the longitudinal direction of the thermal conduction aid 43 decreases gradually toward the lateral edge 43*b* of the thermal conduction aid 43. Accordingly, the lateral edge 43*b* of the lateral end 43*a* of the thermal conduction aid 43 does not come into contact with the inner circumferential surface of the fixing belt 21 easily. Consequently, the fixing device 20S prevents breakage and fracture of the fixing belt 21 precisely.

A description is provided of a configuration of a fixing device 201 incorporating the nip formation unit 200 according to a third exemplary embodiment.

Figure 8:
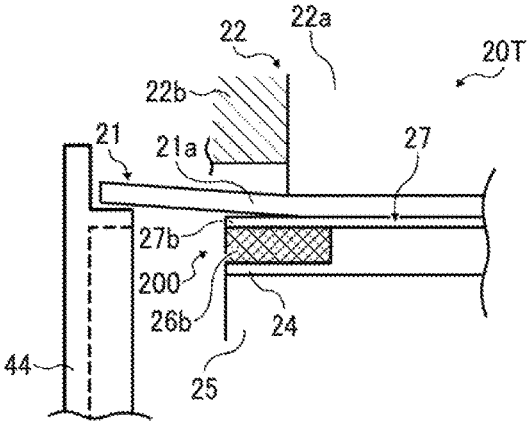
FIG. 8 is a cross-sectional view of the pressure roller, the fixing belt, and the nip formation unit incorporated in the fixing device depicted in FIG. 2 according to a third exemplary embodiment.

FIG. 8 is a cross-sectional view of the pressure roller 22, the fixing belt 21, and the nip formation unit 200. Identical reference numerals are assigned to components illustrated in FIG. 8 that are identical to the components illustrated in FIGS. 5A and 5B and description of the identical components is omitted.

As illustrated in FIG. 8, the fixing belt 21 separates from the thermal conduction aid 27 in an outboard span outboard from the fixing nip N in the axial direction of the fixing belt 21. The fixing belt 21 includes a lateral end 21*a* disposed outboard from a lateral end 22*a* of the pressure roller 22 in the axial direction thereof. The lateral end 21*a* of the fixing belt 21 is disposed opposite a lateral end 27*b* of the thermal conduction aid 27 in the longitudinal direction thereof. The lateral end 21*a* of the fixing belt 21 is bent toward a shaft 22*b* mounted on the pressure roller 22. The shaft 22*b* is a part of the core bar of the pressure roller 22. A support 44 rotatably supports the lateral end 21*a* of the fixing belt 21 and lifts the lateral end 21*a* of the fixing belt 21 toward the shaft 22*b* of the pressure roller 22. The support 44 isolates the inner circumferential surface of the fixing belt 21 from the thermal conduction aid 27, preventing the inner circumferential surface of the fixing belt 21 from coming into contact with the thermal conduction aid 27 and thereby preventing breakage and fraction of the fixing belt 21.

In this case, if the support 44 presses the fixing belt 21 against the pressure roller 22 excessively, the fixing belt 21 may be subject to stress other than contact, resulting in breakage of the fixing belt 21. To address this circumstance, an amount of movement of the lateral end 21*a* of the fixing belt 21 toward the shaft 22*b* of the pressure roller 22 is not greater than 5 percent of the loop diameter of the fixing belt 21.

A description is provided of arrangement of the thermal conduction aid 27 and the lateral end heater 26*b*.

Figure 9:
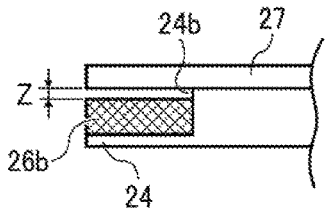
FIG. 9 is a cross-sectional view of a thermal conduction aid, a lateral end heater, and a nip formation pad incorporated in the fixing device depicted in FIG. 2, illustrating a positional relation between the thermal conduction aid and the lateral end heater.

FIG. 9 is a cross-sectional view of the thermal conduction aid 27, the lateral end heater 26*b*, and the nip formation pad 24, illustrating a positional relation between the thermal conduction aid 27 and the lateral end heater 26*b* at one lateral end of the nip formation unit 200 in a longitudinal direction thereof. Although FIG. 9 illustrates one lateral end of the nip formation unit 200 in the longitudinal direction thereof, another lateral end of the nip formation unit 200 in the longitudinal direction is symmetrical with the one lateral end of the nip formation unit 200 depicted in FIG. 9.

According to a depth of the recess 24*b* that accommodates the lateral end heater 26*b* and a thickness of the lateral end heater 26*b*, the lateral end heater 26*b* may not contact the thermal conduction aid 27 and therefore a space Z may be produced between the lateral end heater 26*b* and the thermal conduction aid 27. The space Z may overheat a non-contact portion of the lateral end heater 26*b*, which does not contact the thermal conduction aid 27, causing breakage of the lateral end heater 26*b*. A back-face of the lateral end heater 26*b* may overheat, thermally damaging other components.

Figure 10:
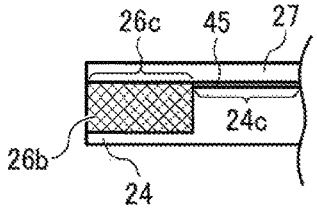
FIG. 10 is a cross-sectional view of the thermal conduction aid, the lateral end heater, and the nip formation pad depicted in FIG. 9, illustrating a belt-side face of the nip formation pad and a belt-side face of the lateral end heater that projects beyond the belt-side face of the nip formation pad.

To address this circumstance, as illustrated in FIG. 10, the belt-side face 26*c* of the lateral end heater 26*b*, that is disposed opposite the thermal conduction aid 27, projects toward the thermal conduction aid 27 beyond the belt-side face 240 of the nip formation pad 24, that is disposed opposite the thermal conduction aid 27. FIG. 10 is a cross-sectional view of the thermal conduction aid 27, the lateral end heater 26*b*, and the nip formation pad 24, illustrating the belt-side face 26*c* of the lateral end heater 26*b* and the belt-side face 24*c* of the nip formation pad 24. Thus, the entire belt-side face 26*c* of the lateral end heater 26*b* contacts the thermal conduction aid 27. Accordingly, heat generated by the lateral end heater 26*b* is conducted to the thermal conduction aid 27, preventing the lateral end heater 26*b* from being broken and thermally damaging other components.

A slight interval 45 may be produced between the thermal conduction aid 27 and the nip formation pad 24 and disposed inboard from the lateral end heater 26*b* in the longitudinal direction of the thermal conduction aid 27. However, since the thermal conduction aid 27 receives substantial pressure from the pressure roller 22 while the sheet P is conveyed through the fixing nip N to fix the toner image on the sheet P, the slight interval 45 does not degrade fixing performance of the pressure roller 22.

A description is provided of variation of arrangement of the thermal conduction aid 27 and the lateral end heater 26*b*.

Figure 11:
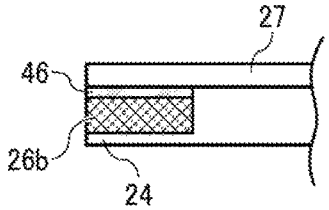
FIG. 11 is a cross-sectional view of the thermal conduction aid, the lateral end heater, and the nip formation pad depicted in FIG. 9, illustrating an elastic body sandwiched between the thermal conduction aid and the lateral end heater.

As illustrated in FIG. 11, an elastic body 46, which is non-conductive and made of silicone rubber, for example, is sandwiched between the lateral end heater 26*b* and the thermal conduction aid 27. FIG. 11 is a cross-sectional view of the thermal conduction aid 27, the lateral end heater 26*b*, the nip formation pad 24, and the elastic body 46. The elastic body 46 absorbs manufacturing error and the like of at least one of the nip formation pad 24 and the lateral end heater 26*b*. The elastic body 46 has a thickness that does not prevent heat conduction from the lateral end heater 26*b* to the thermal conduction aid 27.

Figure 12:
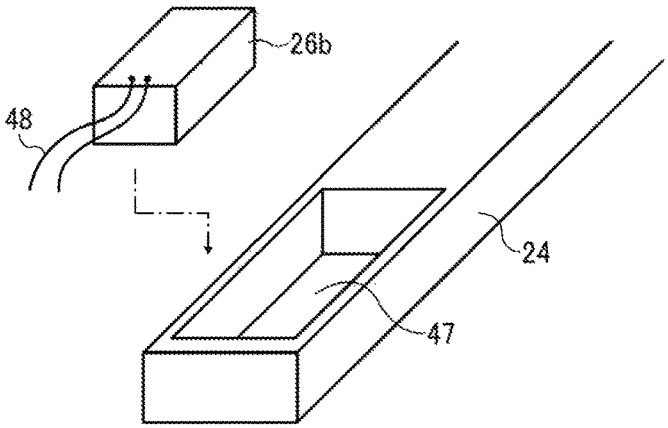
FIG. 12 is a perspective view of the nip formation pad and the lateral end heater depicted in FIG. 9, illustrating a storage provided in the nip formation pad.

The elastic body 46 may be a liquid elastic body such as grease. In this case, a portion of the nip formation pad 24, which accommodates the lateral end heater 26*b*, has a shape that accommodates and holds the liquid elastic body. For example, as illustrated in FIG. 12, the nip formation pad 24 includes a storage 47, that is, a box that opens at one face disposed opposite the thermal conduction aid 27. FIG. 12 is a perspective view of the nip formation pad 24 and the lateral end heater 26*b* before the lateral end heater 26*b* is inserted into the storage 47. The storage 47 houses the lateral end heater 26*b*. A wiring 48 coupled to the lateral end heater 26*b* is cased by a tube disposed above the lateral end heater 26*b* in a gravitational direction, preventing the liquid elastic body from flowing out to the wiring 48.

Although FIGS. 10 to 12 illustrate the lateral end heater 26*b* disposed opposite one lateral end of the thermal conduction aid 27 in the longitudinal direction thereof, the configurations depicted in FIGS. 10 to 12 are also applicable to the lateral end heater 26*a* depicted in FIG. 6A disposed opposite another lateral end of the thermal conduction aid 27 in the longitudinal direction thereof.

A description is provided of advantages of the fixing devices 20, 20S, and 20T.

As illustrated in FIG. 2, a fixing device (e.g., the fixing devices 20, 20S, and 20T) includes an endless belt (e.g., the fixing belt 21) formed into a loop and rotatable in a rotation direction (e.g., the rotation direction D21). A pressure rotator (e.g., the pressure roller 22) is disposed outside the loop formed by the endless belt and disposed opposite an outer circumferential surface of the endless belt. A radiant heater (e.g., the halogen heaters 23A and 23B) is disposed inside the loop formed by the endless belt and disposed opposite an inner circumferential surface of the endless belt to heat the endless belt. A nip formation pad (e.g., the nip formation pad 24) is disposed inside the loop formed by the endless belt and disposed opposite the inner circumferential surface of the endless belt. The nip formation pad forms a fixing nip (e.g., the fixing nip N) between the endless belt and the pressure rotator.

As illustrated in FIG. 3, the nip formation pad includes a belt-side face (e.g., the belt-side face 24*c*) disposed opposite the endless belt. A thermal conduction aid (e.g., the thermal conduction aid 27) covers the belt-side face of the nip formation pad and conducts heat in an axial direction of the endless belt.

As illustrated in FIG. 6A, at the fixing nip, a first span (e.g., the span S22) of the pressure rotator in an axial direction thereof is within a second span (e.g., the span S27) of the thermal conduction aid in a longitudinal direction thereof. Each of the axial direction of the pressure rotator and the longitudinal direction of the thermal conduction aid is parallel to the axial direction of the endless belt.

Since the first span of the pressure rotator in the axial direction thereof is within the second span of the thermal conduction aid in the longitudinal direction thereof at the fixing nip, a lateral edge of the thermal conduction aid in the longitudinal direction thereof does not bend a lateral end (e.g., the lateral end 21*a*) of the endless belt in the axial direction thereof. Since the inner circumferential surface of the endless belt barely contacts the lateral edge of the thermal conduction aid, even while the endless belt rotates, the endless belt does not continue sliding over the lateral edge, of the thermal conduction aid. Accordingly, the fixing device prevents breakage and fracture of the endless belt, which, originates from the inner circumferential surface of the endless belt, thus improving durability of the endless belt.

According to the exemplary embodiments described above, as illustrated in FIG. 6A, the fixing device 20 employs a center conveyance system in which the sheet P is centered on the fixing belt 21 in the axial direction thereof.

Alternatively, the fixing device 20 may employ a lateral end conveyance system in which the sheet P is conveyed in the sheet conveyance direction DP along one lateral end of the fixing belt 21 in the axial direction thereof. In this case, one of the lateral end heaters 26*a* and 26*b* is eliminated. Another one of the lateral end heaters 26*a* and 26*b* is distal from the one lateral end of the fixing belt 21 in the axial direction thereof.

According to the exemplary embodiments described above, the fixing belt 21 serves as an endless belt. Alternatively, a fixing film, a fixing sleeve, or the like may be used as an endless belt. Further, the pressure roller 22 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

an endless belt;

a pressure rotator disposed opposite an outer circumferential surface of the endless belt, the pressure rotator having a first span in an axial direction of the endless belt;

a nip formation pad, disposed opposite an inner circumferential surface of the endless belt, to form a fixing nip between the endless belt and the pressure rotator, the nip formation pad including a belt-side face disposed opposite the endless belt;

a radiant heater, disposed opposite the inner circumferential surface of the endless belt, to heat the endless belt; and a thermal conduction aid that is made of metal, contacting the belt-side face of the nip formation pad, to conduct heat in the axial direction of the endless belt, the thermal conduction aid having a second span within which the first span of the pressure rotator is provided at the fixing nip.

2. The fixing device according to claim 1, wherein the thermal conduction aid includes a lateral end disposed outboard from the pressure rotator in the axial direction of the endless belt.

3. The fixing device according to claim 2, wherein a thickness of the lateral end of the thermal conduction aid in a direction perpendicular to the axial direction of the endless belt decreases gradually toward a lateral edge of the thermal conduction aid in the axial direction of the endless belt.

4. The fixing device according to claim 3, wherein the lateral end of the thermal conduction aid includes a slope that tapers off the lateral edge of the thermal conduction aid.

5. The fixing device according to claim 2, wherein the pressure rotator mounts a shaft disposed outboard from the pressure rotator in the axial direction of the endless belt, and wherein the endless belt includes a lateral end disposed outboard from the pressure rotator in the axial direction of the endless belt and disposed opposite the lateral end of the thermal conduction aid, the lateral end of the endless belt being bent toward the shaft of the pressure rotator.

6. The fixing device according to claim 5, further comprising:

a support supporting the lateral end of the endless belt and lifting the lateral end of the endless belt toward the shaft of the pressure rotator.

7. The fixing device according to claim 1, further comprising:

a contact heater, disposed at a lateral end of the nip formation pad in the axial direction of the endless belt, to heat the endless belt.

8. The fixing device according to claim 7, wherein the contact heater includes a belt-side face being disposed opposite the thermal conduction aid and projecting toward the thermal conduction aid beyond the belt-side face of the nip formation pad.

9. The fixing device according to claim 7, further comprising:

an elastic body that is non-conductive and sandwiched between the contact heater and the thermal conduction aid.

10. The fixing device according to claim 9, wherein the elastic body is made of silicone rubber.

11. The fixing device according to claim 9, wherein the elastic body includes a liquid elastic body.

12. The fixing device according to claim 11, wherein the liquid elastic body is made of grease.

13. The fixing device according to claim 11, wherein the nip formation pad includes a storage housing the contact heater and the liquid elastic body.

14. The fixing device according to claim 13, wherein the storage opens at one face disposed opposite the thermal conduction aid.

15. An image forming apparatus comprising:

an image forming device to form a toner image; and a fixing device disposed downstream from the image forming device in a recording medium conveyance direction to fix the toner image on a recording medium, the fixing device including:

an endless belt;

a pressure rotator disposed opposite an outer circumferential surface of the endless belt, the pressure rotator having a first span in an axial direction of the endless belt;

a nip formation pad, disposed opposite an inner circumferential surface of the endless belt, to form a fixing nip between the endless belt and the pressure rotator, the nip formation pad including a belt-side face disposed opposite the endless belt;

a radiant heater, disposed opposite the inner circumferential surface of the endless belt, to heat the endless belt; and a thermal conduction aid that is made of metal, contacting the belt-side face of the nip formation pad, to conduct heat in the axial direction of the endless belt, the thermal conduction aid having a second span within which the first span of the pressure rotator is provided at the fixing nip.

16. The fixing device according to claim 1, wherein an end of the thermal conduction aid is disposed between an end of the endless belt and an end of the pressure rotator in the axial direction of the endless belt.

* * * * *